United States Patent [19]

Pronk

[11] Patent Number: 4,623,095

[45] Date of Patent: Nov. 18, 1986

[54] LIQUID ADDING APPARATUS AND METHOD FOR A SHOWER FIXTURE

[76] Inventor: Frank E. Pronk, Box 30 Nautilus Road, RR 2, Nanoose Bay, British Columbia, Canada, V0R 2R0

[21] Appl. No.: 673,515

[22] Filed: Nov. 19, 1984

[51] Int. Cl.[4] ..... B05B 7/30

[52] U.S. Cl. ..... 239/311; 239/318

[58] Field of Search ..... 239/310,311,318,428.5; 222/168,484,548

[56] References Cited

U.S. PATENT DOCUMENTS

| | | | |
|---|---|---|---|
| 2,200,024 | 5/1940 | Sipio et al. | 222/548 X |
| 2,743,913 | 5/1956 | Gundlach | 239/311 |
| 3,003,703 | 3/1959 | Lambton . | |
| 3,071,081 | 12/1960 | Mullick . | |
| 3,112,884 | 12/1963 | Gilmour | 239/318 |
| 3,231,200 | 1/1966 | Heald | 239/318 |
| 3,612,404 | 10/1971 | Vicari . | |
| 3,797,747 | 3/1974 | Buzzi et al. . | |
| 3,847,354 | 11/1974 | Lemond . | |
| 3,894,662 | 7/1975 | Eddy et al. | 239/318 X |
| 4,121,773 | 10/1978 | Headen et al. . | |
| 4,189,100 | 2/1980 | Karp . | |
| 4,200,206 | 4/1980 | Chase et al. . | |
| 4,322,036 | 3/1982 | Bly . | |

*Primary Examiner*—Joseph F. Peters, Jr.
*Assistant Examiner*—Daniel R. Edelbrock
*Attorney, Agent, or Firm*—Hughes & Cassidy

[57] ABSTRACT

A device to air entrain and add liquid soap or some other liquid to the water stream which flows through a shower head. There is a secondary liquid additive passageway leading into a constricted reduced pressure area of the main flow passageway of the shower water. There is a container rotatably mounted in a manner to either shut off flow of the liquid soap or other liquid, or to selectively meter the flow into the main water stream by selectively aligning aspirating air holes with an aspirating air passageway that leads into the secondary passageway.

28 Claims, 10 Drawing Figures

LIQUID ADDING APPARATUS AND METHOD FOR A SHOWER FIXTURE

BACKGROUND OF THE INVENTION

1. Field of the Invention

The present invention relates to an apparatus and method for air entraining and selectively introducing liquid soap or some other liquid into the water stream that flows through a shower fixture.

Cross Reference to Related Applications and Disclosure Documents

This application is based upon disclosure documents 127,772, 128,452 and 129,774, filed in the U.S. Patent & Trademark Office.

2. Background Art

The common method of a person taking a shower is to have plain water flow through the shower head onto the person's body, with the person applying the soap by hand or brush to the person's body. However, there have been various proposals to add the soap or other liquid, such as bath oil, into the stream of water that flows from the shower. Also, there have been proposals to add air into the water stream prior to emitting the water from the shower head, so that the entrained air in the water gives a different feel or effect when the water impacts the person's body.

A search of the patent literature has revealed a number of U.S. patents which disclose various devices which were designed to achieve one or more of the above functions.

U.S. Pat. No. 2,743,913, Gunblach, shows a device for dispensing liquid detergent or soap into the water stream that flows from a shower head. There is a soap container which has an outlet opening which leads into the passageway for the water that flows through the shower. The container is rotatably mounted between a lower position and an upper position. In the lower position, soap does not flow through the passageway into the water stream, but when the container is moved to the upper position, the soap flows by gravity into the water stream. There is also an opening to permit ambient air to mix with the soap that flows into the stream.

U.S. Pat. No. 3,003,703, Lambton, shows another device for introducing soap or other liquid into the water stream that flows through a shower. There is a convergent/divergent water passageway, and the soap or other liquid is introduced into the narrow part of the passageway so that the reduced pressure of the water at that point aspirates the soap into the water stream. The device has a plurality of small spherical containers, each of which can be selectively pierced to permit the soap or other liquid contained therein to flow into a chamber where it can then be aspirated into the water stream.

U.S. Pat. No. 3,071,081, Mullick, shows another device for aspirating a liquid into the water stream of a shower, and this comprises a container positioned at a location below the shower, and having an upwardly extending passageway leading into a low pressure area of the water stream. There is a venting air passageway leading into the detergent passageway, and this air passageway can be selectively closed by a flap valve. When the flap valve is open, the air is aspirated into the passageway instead of the liquid, so that no liquid is delivered into the stream. Liquid can be caused to be aspirated into the water stream by closing the flap valve.

U.S. Pat. No. 3,231,200, Heald, shows a device which operates on somewhat the same principle as the above-noted patent to Mullick. In this patent, there is a rotating valve member positioned between the soap or other additive liquid passageway and the water passageway. In the closed position, the valve can close the liquid soap to the water passageway. The valve has another position where liquid soap is aspirated upwardly into the water passageway, along with a certain amount of air, to form a suds-like flow from the shower.

U.S. Pat. No. 3,612,404, Bicari, shows a device to introduce liquid soap into the water stream of the shower. The soap container is positioned above the flow passageway for the shower, and there is a slide valve which can be selectively positioned to permit either clear water to flow through the shower, or to permit soap to be introduced into the stream. There is a mixing chamber in the housing of the device where the soap can be mixed with water and then introduced into the water stream.

U.S. Pat. No. 3,797,747, Buzzi, shows a device to aspirate liquid additives into the shower stream, with the liquid additive container being positioned below the stream of water that flows through the shower. The liquid is aspirated upwardly into the flow of water.

U.S. Pat. No. 3,847,354, Lemond, illustrates a device where bath oils can be injected into the stream of water which flows through a convergent/divergent passageway. The bath oil container is positioned below the stream of water. Water at an upstream location which is at a high pressure can be directed downwardly into the bath oil container which then causes a flow through a second passageway from the container back into the water stream. There is a manually operated valve which controls the flow of water into the bath oil container.

U.S. Pat. No. 4,121,773, Headon, shows a shower head dispenser which is rather similar in construction to the Lemond device. However, instead of having a valve to selectively admit the higher pressure water flow into the container for the liquid to be added, the housing to which the container is attached can be rotated about the lengthwise axis of the shower head member so as to open or close the passageway leading into the container.

U.S. Pat. No. 4,189,100, Karp, shows a fluid dispenser for a shower bath where the reservoir for the fluid to be added is positioned above the flow of the stream of water. There is a valve which can be selectively operated to admit the fluid to be added into the shower stream.

U.S. Pat. No. 4,200,206, Chase, shows a fluid dispenser to inject a liquid into the shower water stream, where there are three separate containers for liquid to be added. The liquid to be added falls into a chamber, and water from the shower stream is bypassed to flow over the weir and into the chamber so that the outlet valves of the containers remain clean.

U.S. Pat. No. 4,322,036, Bly, shows yet another device where liquid additives are aspirated into the shower water stream. By selectively controlling a vent tube, the flow of the liquid additive can be controlled.

To the best knowledge of the applicant, few of these devices described above (if any) have had any wide consumer acceptance. While the applicant herein is not in a position to state authoritatively why this has occurred, it can be surmised that many of the prior art devices have either been too bulky, somewhat complex in structure and/or operation, or possibly not totally practical or reliable.

Accordingly, it is an object of the present invention to provide an effective apparatus and method for adding liquid soap or some other additive liquid into the stream of water that passes through and from a shower fixture. It is a more specific object to provide such an apparatus which is simple in structure, economical to manufacture, convenient and economical to operate, and yet quite capable of adequately performing its intended functions of properly air entraining and metering the flow of additive liquid.

SUMMARY OF THE INVENTION

The apparatus of the present invention is arranged to selectively air entrain and introduce an additive liquid into a stream of water flowing through a shower head. This apparatus comprises a main housing member defining a first main through passageway for flow of shower water therethrough. The passageway has a reduced flow area passageway portion to create a low static pressure flow area.

There is a second dispensing member connected to the housing member and defining a second passageway having an inlet end and an outlet end. The outlet end leads into the low pressure area of the first passageway.

There is an additive liquid container defining a containing chamber and adapted to be mounted to the second member so that the container can be moved relative to the second member and so that the inlet of the second passageway communicates with the containing chamber. The second member and the container collectively define selectively operable aspirating air passageway means connecting to the second passageway. The air passageway means is arranged so that relative movement between the container and the second member to selected positions results in greater or less air flow through the air passageway means to the second passageway to affect flow of additive liquid through the second passageway to the first main passageway.

In the preferred form, the second member has a lengthwise axis, with the second member extending outwardly from the first main passageway along the lengthwise axis. The container is mounted for rotation about the lengthwise axis for selective operation of the air passageway means.

Desirably, the air passageway means comprises a third passageway formed in the second member and leading to the second passageway. The container has a mounting portion engaging the second member, and the mounting portion has air opening means of variable cross-sectional area. More specifically, the air opening means comprises a plurality of through air openings of different sizes, or a circumferentially tapered slot.

Also, in the preferred form, the container is provided with a shutoff member positioned in the container so as to be able to come into closing engagement with the inlet of the second passageway. The shutoff member is positioned so that when it is at a shutoff position, the container is positioned so that the air openings are out of alignment with the inlet of the third passageway, or alternatively, the circumferentially tapered slot is not engaged to the third passageway.

Preferably, the dispensing member is positioned relative to the main housing to position the container at a location where the containing chamber is above the outlet end of the second member. Thus, additive liquid in the containing chamber tends to flow by gravity to the first passageway.

Also, in the preferred configuration, the second member has a lengthwise axis extending outwardly from the first passageway and the second member has a generally cylindrical configuration about its lengthwise axis. The second passageway extends generally parallel to the lengthwise axis and has an inlet portion proximate an outer end of the second member. The inlet is positioned radially outwardly of the lengthwise axis of the second member, and the air passageway extends laterally in the second member to connect to the second passageway.

In another embodiment, there are two sets of air openings formed in the mounting portion of the container, with the two sets of air openings being positioned diametrically opposite to one another. Each set is made up of openings of varying sizes, whereby the container can be rotated in either of two directions to accomplish selective positioning of either set of openings. Alternatively, there are two circumferentially tapered slots positioned diametrically opposed to one another whereby the container can be rotated in either of two directions to accomplish selective positioning of either slot.

In another form, there are a plurality of shutoff members which are positioned to come into closing engagement with the inlet to the second passageway when the container is positioned so that adjacent pairs of openings are out of alignment with the air passageway. Thus, when the container is being rotated to one air opening alignment position from another air opening alignment position, flow of liquid is shut off during movement of the container from the one air opening alignment position to the other.

Further, the present invention comprises an apparatus made up of the main housing member and the second dispensing member as described above, with this apparatus being particularly adapted to receive a container such as described above. Further, the present invention comprises the container itself, as described above, with the container particularly adapted to be used with the dispensing device as described above.

In one configuration, the container is an open container which in its installed position has an open upper end into which additive liquid can be poured. In another configuration, the container is a closed container, and the mounting member has a removable closing member that can be opened by inserting the mounting portion onto the second dispensing member.

In the method of the present invention, the container, such as described above, is mounted to the second dispensing member in its "off" position. Then water is directed through the main housing member so as to flow through the main passageway and produce a low static pressure at the reduced flow area passageway portion. The container is selectively rotated to an operating position, to selectively permit the flow of additive liquid and air into the main flow of shower water. The rate of flow of additive liquid is determined by the amount of aspirating air directed into the second passageway by virtue of the selected operating position.

Other features of the present invention will become apparent from the following detailed description.

DESCRIPTION OF THE PREFERRED EMBODIMENTS

Figure 1:
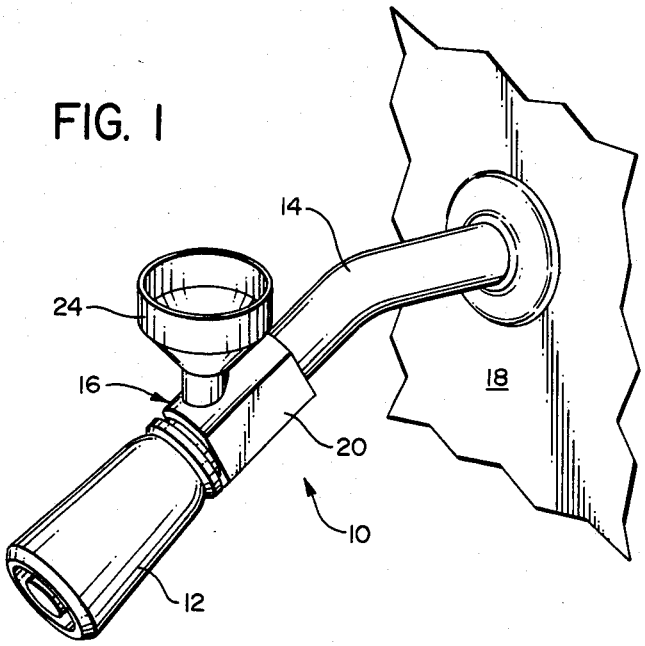
FIG. 1 is an isometric view of a conventional shower fixture having the additive liquid dispensing device in the present invention mounted in the water fixture.

With reference to FIG. 1, there is shown a conventional shower fixture with the dispensing device of the present invention mounted in the shower fixture. This overall shower fixture/dispensing device combination is generally designated 10. It comprises a shower head 12, which is or may be of conventional design, a water supply pipe 14, and the additive liquid dispensing device 16 of the present invention. As is conventional with such shower fixtures, the water pipe 14 extends outwardly from the shower wall 18, and then extends downwardly and outwardly from the wall 18 at approximately a 45° angle.

The dispensing device of the present invention comprises three main components, namely a main housing 20, a dispensing member 22, and a liquid container 24. At the rear end of the housing 20, there is a connecting portion 26 having an interiorly threaded socket to engage the threaded end portion 28 of the pipe 14. The forward end 30 of the housing 20 has exterior threads to engage the interior threads of the shower head 12.

The housing 20 defines a convergent/divergent through passageway, generally designated 32, and having a rear forwardly converging portion **32*a*, a middle portion 32*b* of a relatively small diameter, and a forward portion 32*c* having a diameter and cross-sectional area greater than that of the passageway portion 32*b*. Thus, as water flows from the pipe 14 and through the passageway sections 32*a–c* and into the shower head 12, there is a venturi effect so that there is reduced static pressure in the water flowing through the relatively narrow passageway section 32*b***.

In further describing the present invention, the dispensing device 16 shall be considered as having a longitudinal axis which is coincident with the centerline of the passageway sections **32*a–c*. Further, the term "front" or "forward" shall denote a location further away from the shower wall 18, while the terms "rearward" or "rear" shall denote proximity to, or a closer location to, the wall 18**.

The dispensing member 22 has a generally cylindrical configuration, and is mounted to the housing 20 so as to extend upwardly therefrom. The member 22 has a lower threaded end connecting portion 36 which engages a vertically aligned matching threaded socket 38 formed in the upper portion of the housing 20. The socket 38 is aligned in the housing 20 so that with the housing 20 in its installed location where its longitudinal axis extends downwardly at approximately a 45° angle, the socket 38 is approximately vertically oriented, so that the center axis of the member 22, as determined by the cylindrical configuration of the member 22, is essentially vertically aligned.

The dispensing member 22 is formed with a through passageway 40, the major portion of which is coincident with the longitudinal center axis of the member 22. The lower end of the passageway 40 leads into a short passageway portion 42 (which is a continuation of the passageway 40), which in turn leads into the end portion of the narrow main passageway section **32*b*. At the upper end of the member 22, the passageway 40 slants from the longitudinal center axis of the member 22 laterally and upwardly to form a passageway inlet 44. The reason for this arrangement of the inlet 44 is to enable the passageway 40** to be shut off conveniently, and this will be described in more detail later herein.

At a location between the inlet 44 and the socket 38, the dispensing member 22 is formed with an air passageway 46 that connects to the passageway 40 between the inlet and outlet ends thereof. As will be disclosed hereinafter, this passageway 46 is selectively closed or opened to inlet openings of various sizes as a means of controlling flow of the additive liquid through the passageway 40 and into the passageway section **32*b***.

Figure 2:
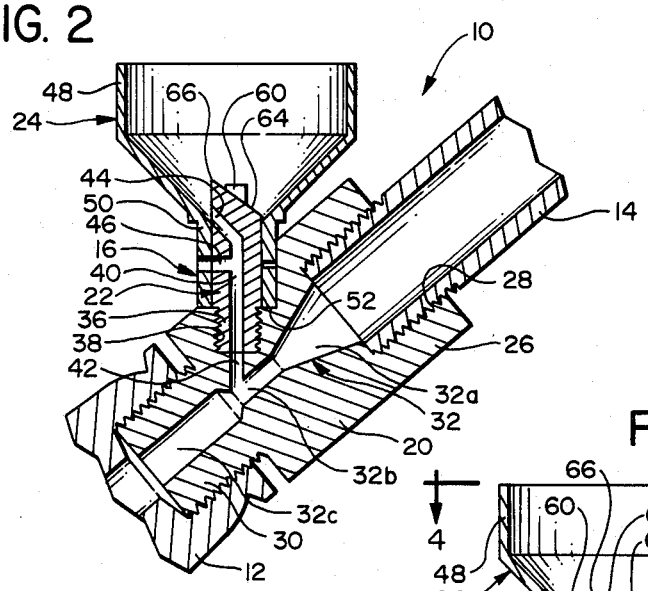
FIG. 2 is a longitudinal sectional view taken along a vertical plane passing through the dispensing apparatus of the present invention, with the additive liquid container in one liquid dispensing position.

The container 24 has an upper main containing section 48 and a lower neck or mounting portion 50. The neck portion 50 is cylindrically shaped and is sized so that it can be mounted onto the dispensing member 22, with the inner surface of the neck portion 50 fitting snuggly around the exterior surface of the member 22. As shown in FIG. 2, the lower edge 52 of the container neck 50 rests against an abutting surface formed in the housing 20 so as to properly locate the container 24 relative to the dispensing member 22. The fit between the neck portion 50 and the dispensing member 22 is sufficiently tight so that liquid in the container 24 will not leak out between the neck 50 and member 22, and yet not so tight as to prevent rotational movement of the container 24 relative to the dispensing member 22.

The container 24, in addition to holding the liquid which is to be added to the water stream, cooperates with the dispensing member 22 to perform two other important functions, namely: (a) to open or close the inlet passageway portion 44 so as to shut off flow of the additive liquid or permit flow thereof through the passageway 40; and (b) to selectively control the airflow into the air passageway 46 as a means of metering flow of the liquid through the passageway 40.

Figure 5:
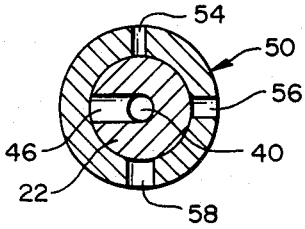
FIG. 5 is a sectional view taken along line 5—5 of FIG. 3, and showing the aspirating opening of the present invention.

The neck portion 50 of the container 24 is provided at spaced locations about the circumference thereof with a plurality of through openings, which in the specific arrangement shown in FIG. 5 comprise a relatively small opening 54, an intermediate sized opening 56, and a full sized opening 58. These three openings 54–58 are positioned so that with the container 24 mounted as shown in FIG. 2, the openings 54–58 are horizontally aligned with the air passageway 46. Thus, it can be appreciated that the various openings 54–58 can each selectively be brought into alignment with the air passageway 46, by rotating the container 24 to the appropriate location.

The container 24 is also provided with a stop member 60 positioned just above the neck portion 50. This stop member 60 has a vertically aligned face or surface 62 which is positioned so that it can come into closing engagement with the inlet opening of the passageway section 44 when the container 24 is rotated to the shutoff position. Thus, the passageway 40 can quite easily be closed or opened, by rotating the container 24 about its vertical center axis.

Figure 9:
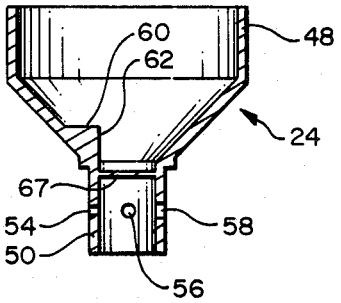
FIG. 9 is a sectional view of the mounting portion of the container provided with a rupturable closure diaphragm.

The upper surface 64 of the dispensing member 22 is formed at a slant with respect to the longitudinal center axis of the member 22, so that it forms an upwardly directed sharp edge 66. The reason for this is that the neck 50 of the container 24 can be closed with a rupturable cover or membrane 67, as shown in FIG. 9. Thus, the container 24, with the liquid therein, can be positioned with the neck portion 50 facing down, and the liquid will not run out of the container 24 since the membrane or closure member closes off the neck portion 50. By pushing the neck portion 50 downwardly over the dispensing member 22, the edge 66 will cut through the membrane or closure member to open the neck portion 50.

To describe the operation of the present invention, first, the method of installation will be described. The installation can be accomplished quite simply by unthreading the shower head 12 from the pipe 14, threading the rear end portion of the housing member 20 onto the threaded end of the pipe 14, after which the shower head 12 is threaded onto the lower forward end portion 30 of the housing 20. As shown herein, the container 24 is open at one end, so that when it is in its installed position, as shown in FIGS. 1 and 2, the liquid to be added to the water stream can be poured into the top of the container 24.

Initially, the container 24 is positioned about the dispensing member 22 so that the shutoff member 60 is located against the inlet opening of the passageway section 44 so as to prevent any flow of the liquid from the container 24 into the passageway 40. As can be seen in FIG. 5, when the container 24 is in that shutoff position, the three openings 54–58 are out of alignment with the air passageway 46. With the container 24 in this position, the shower fixture/dispensing device combination 10 will function in substantially the same fashion as a conventional shower fixture. In other words, the water will flow through the pipe 14, through the passageway sections 32*a–c*, and out through the shower head 12.

If the person taking the shower now desires to have the liquid in the container 24 metered into the flow of shower water, then the person rotates the container 24 so that the appropriate opening 54–58 is in alignment with the air passageway 46. Rotating the container 24 in this manner accomplishes two functions. First, it brings the inlet passageway section 44 out of engagement with the shutoff member 60 so that liquid in the container 24 is able to flow into the passageway 40. Second, by bringing a selected one of the openings 54–58 into alignment with the air passageway 46, the rate of flow of the liquid can be controlled.

To explain how this latter function is accomplished, first, it should be recognized that as the water from the pipe 14 flows through the constricted passageway section 32*b*, the velocity of the water increases so as to translate the static pressure of the water into dynamic pressure head, thus creating lower static pressure at the location of the passageway section 32*b*. This creates reduced pressure in the passageway inlet 40 so that air is drawn in through the air passageway 46, and liquid from the container 24 is drawn into the passageway inlet 44 and into the passageway 40.

Figure 3:
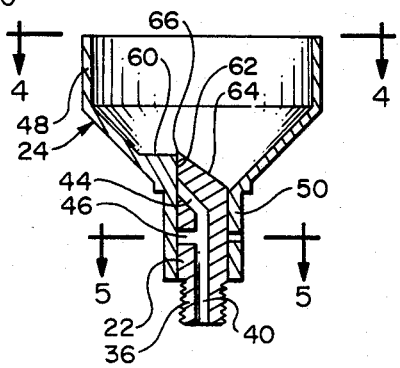
FIG. 3 is similar to FIG. 2, but showing only the container and the liquid dispensing member to which it is mounted, with the container being in its shutoff position where no additive liquid flows into the water stream.

If the smallest opening 54 is in alignment with the air passageway 46, the flow of air will be restricted so that there would be lower pressure in the passageway 40 to produce a greater rate of flow of liquid into the passageway 40. By placing the intermediate opening 56 in alignment with the air passageway 46*a*, lesser rate of flow of liquid from the container 24 will be produced, while the lowest flow of liquid from the container 24 will be produced by bringing the largest opening 58 into alignment with the air passageway 46. When the person desires to stop the flow of the liquid soap or other liquid from the container 24, the person rotates the container 24 back to its shutoff position as shown in FIG. 3.

To summarize some of the significant features of the present invention, it is to be noted that the dispensing apparatus 14 is easy to install, and once installed, it is in a convenient location where it can easily be operated. Thus, it does not interfere with the normal operation of a person taking a shower.

Further, it will be noted that the overall structure of the dispensing device 16 is quite simple, with only one moving part (i.e. the container 24). Further, functionally the apparatus has been simplified, relative to many of the prior art devices, in that the several functions have been in a sense combined into one operating maneuver. To explain this more fully, it will be noted that the container 24 serves not simply the usual function of containing the liquid to be added to the water stream. Rather, as indicated previously, two additional functions have been assigned to the container 24. First, there is the shutoff function accomplished by the member 60. Secondly, there is the additive liquid metering and air aspirating function accomplished by selective alignment of the holes 54–58 with the air passageway 46. Both the shutoff function and the metering function are accomplished by the rotational movement of the container 24.

Figure 6:
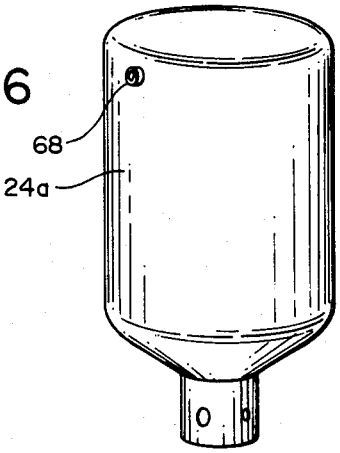
FIG. 6 is an isometric view of a container adapted for use in the present invention.

In FIG. 6, there is shown a closed container 24*a*, instead of the open container configuration shown at 24 with reference to the embodiment of FIGS. 1–5. In terms of function, the container 24*a* of FIG. 6 is the same as the first described container 24, except that by making the container 24 entirely closed, it is possible to store the fluid prior to use in the very same container which is mounted to the member 22 and becomes functionally part of the dispensing device 16. The container 24*a* is provided with a vent opening 68 which could be closed by a rupturable closure member or membrane, such as shown at 67 in FIG. 9. Then, once the container 24*a* is placed in its operating position (i.e. positioned on the dispensing member 22), the vent opening 68 could be opened. Alternatively, the bottom of the container could be thermo-sealed, tab sealed or sealed or closed in another suitable manner, with ease of breaking, puncturing, or removing the seal during or upon placing the container in its operating position.

Figure 7:
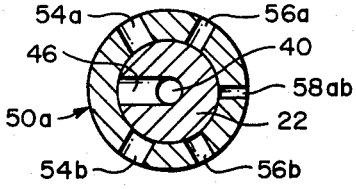
FIG. 7 is a view similar to FIG. 5, showing a modified arrangement of air intake openings in the container.

In FIG. 7, there is shown a modified version of the neck portion 50*a* of the container 24 or 24*a*. Instead of having only one set of openings 54–58, there are provided two sets of openings on opposite sides of the neck portion 50*a*. Thus, there are openings 54*a* and 56*a* on one side of the neck portion 50 or 50*a*, and a second set of openings 54*b* and 56*b* on the other side and finally a fifth opening 58*ab*. The reason for this arrangement is that some people, by virtue of being either right or left handed, may have a tendency to rotate the container 24*a* in one direction rather than in the other, and the arrangement of FIG. 7 would allow for this. Similarily, FIG. 10 shows a second alternative circumferentially tapered slot 71 to accommodate rotation of container 24 or 24*a* in two directions.

Figure 4:
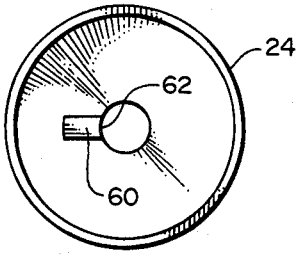
FIG. 4 is a plan view taken from the location indicated at 4—4 of FIG. 3.
Figure 8:
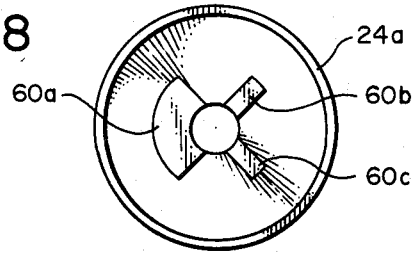
FIG. 8 is a view taken from the same location as FIG. 4, and showing a further modification.

A further modification is illustrated in FIG. 8, which is a view similar to FIG. 4. In FIG. 8, instead of having the single shutoff member 60 which closes the passageway inlet 44 at only one location of the container 24 or 24*a*, there are provided three stop members 60*a*, 60*b* and 60*c*. These are arranged so that one of the shutoff members 60*a–c* would come into alignment with the passageway innlet 44 when the container 24 is moving between alignment positions of any of the openings 54–58 with the air passageway 46. The reason for this is that there is maximum flow of liquid from the container 24 when the passageway inlet 44 is open and the air passageway 46 is totally closed. Thus, during the short interval when the container 24 is being moved between two alignment positions with the air passageway 46, there may be an unwanted surge of the liquid flowing from the container 24. The arrangement of FIG. 8 alleviates this by closing the inlet 44 when the openings 54–58 are out of alignment with the air passageway 46.

Figure 10:
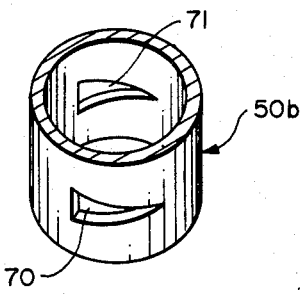
FIG. 10 is an isometric view of the mounting portion of the container showing the alternative circumferentially tapered slot(s) functioning as air intake openings.

Alternatively, as shown in FIG. 10, in lieu of the plurality of through openings the neck portion 50*b* is provided with a circumferentially tapered slot 70 shown in FIG. 10. This slot is positioned so that with the container 24 mounted as shown in FIG. 2, the slot 70 is horizontally aligned with the air passageway 46. By rotating the container 24, air intake can thus be selected as required. A second slot 71 may be added.

It is to be understood that the device 16 may be incorporated into the shower head so that the shower head 12 and dispensing device 16 are supplied as a single unit. Further, the apparatus may be produced in brass with chrome finish, stainless steel, or a suitable plastic. Desirably, the container 24 is produced in translucent plastic.

As a further modification, the positioning of the dispensing member 22, excepting its air passageway 46, may be rotated 180° from the position shown in FIG. 2, thus giving it a lower profile, relative to the housing 20.

When the container 24 is not to be used for extended periods, it is possible to remove the container 24 from the dispensing member 22, and provide the dispensing member 22 with a cap. The cap could be arranged to totally close the air passageway opening 46 and the second passageway opening 44, or to provide a certain amount of air entrainment by aligning an opening of the cap with the air passageway 46, or possibly the second passageway portion 44.

It is to be understood that other modifications could be made without departing from the teachings of the present invention.

I claim:

1. An apparatus to selectively introduce an additive liquid into a stream of water flowing through a shower head, said apparatus comprising:

a. a main housing member defining a first main through passageway for flow of shower water therethrough, said passageway having a reduced flow area passageway portion to create a low static pressure flow area;

b. a second dispensing member connected to said housing member and defining a second passageway having an inlet end and an outlet end leading into the low pressure flow area of the first passageway;

c. an additive liquid container defining a containing chamber and adapted to be mounted to said second member so that said container can be moved relative to the second member and so that said inlet of the second passageway communicates with the containing chamber with said container being positioned so that there is a gravitational component of flow from said containing chamber to said second passageway; and d. the second member and the container collectively defining selectively operable aspirating air passageway means connecting to said second passageway, said air passageway means being arranged so that relative movement between the container and the second member to selected positions relusts in greater or less air flow through the air passageway means to the second passageway while flow of the additive liquid is maintained through said second passageway, to vary flow of additive liquid through the second passageway to the first main passageway.

2. The apparatus as recited in claim 1, wherein said second member has a lengthwise axis, with the second member extending outwardly from the first main passageway along said lengthwise axis, and said container is mounted for rotation about said lengthwise axis for selective operation of the air passageway means.

3. The apparatus as recited in claim 2, wherein said air passageway means comprises a third passageway formed in said second member and leading to said second passageway, and said container has a mounting portion engaging said second member, said mounting portion having air opening means of variable cross-sectional area, said apparatus being arranged so that inlet area of the air opening means leading into the third passageway can be varied by selectively moving the container to differing positions relative to the second member.

4. The apparatus as recited in claim 1, wherein said air passageway means comprises a third passageway formed in said second member and leading to said second passageway, and said container has a mounting portion engaging said second member, said mounting portion having air opening means of variable cross-sectional area, said apparatus being arranged so that inlet area of the air opening means leading into the third passageway can be varied by selectively moving the container to differing positions relative to the second member.

5. The apparatus as recited in claim 1, wherein said second member has a generally circular cross-sectional configuration, and said container has a mounting portion which fits over said second member in mounting engagement therewith, said air passageway means comprising a third air passageway extending through said second member to said second passageway, said mounting portion of the container having a plurality of through air openings of different sizes, said apparatus being arranged so that air flow through the third passageway can be controlled by selectively aligning one of said air openings with said air passageway.

6. The apparatus as recited in claim 5, wherein said container is mounted to said second member for rotation about a lengthwise axis of said second member, and said air openings are selectively aligned with the third passageway by rotating the container relative to the second member.

7. The apparatus as recited in claim 6, wherein said container is provided with a shutoff member positioned in said container so as to be able to come into closing engagement with an inlet of the second passageway, said shutoff member being positioned so that when it is at a shutoff position, the container is positioned so that the air openings are out of alignment with the inlet of the third passageway.

8. The apparatus as recited in claim 1, wherein said second member has a generally circular cross-sectional configuration, and said container has a mounting portion which fits over said second member in mounting engagement therewith, said air passageway means comprising a third air passageway extending through said second member to said second passageway, said mounting portion of the container having a tapered opening means, said apparatus being arranged so that air flow through the third passageway can be controlled by selectively aligning portions of the tapered opening means with said third air passageway.

9. The apparatus as recited in claim 1, wherein said container has a shutoff member arranged to come into closing engagement with an inlet to the second passageway when the container is in a predetermined position relative to the second member, whereby by moving the container relative to the second member, flow of liquid in the container through the second passageway can be controlled, and flow of air into the second passageway can also be controlled.

10. The apparatus as recited in claim 1, wherein said second member has a lengthwise axis extending outwardly from said first passageway and said second member has a generally cylindrical configuration about its lengthwise axis, said second passageway extending generally parallel to said lengthwise axis and having an inlet portion proximate an outer end of said second member, with said inlet being positioned radially outwardly of the lengthwise axis of the second member, said air passageway means comprising a third air passageway extending laterally in said second member to connect to the second passageway, said container having a mounting portion fitting around said second member, said container having a plurality of air openings of varying sizes, said container being rotatably mounted to said second member in a manner that selected ones of said air openings can be brought into alignment with said third air passageway, said container having a stop member which can be brought into closing engagement with the inlet for the second passageway by rotating the container relative to the second member to an appropriate shutoff position.

11. The apparatus as recited in claim 10, wherein there are two sets of air openings formed in the mounting portion of the container, with the two sets of air openings being positioned diametrically opposite to one another, with each set being made up of openings of varying sizes, whereby the container can be rotated in either of two directions to accomplish selective positioning of either set of openings.

12. The apparatus as recited in claim 10, wherein there are a plurality of shutoff members which are positioned to come into closing engagement with the inlet to the second passageway when the container is positioned so that adjacent pairs of air openings are out of alignment with the air passageway whereby when the container is being rotated to one opening alignment position from another opening alignment position, flow of liquid is shut off during movement of the container from the one opening alignment position to the other.

13. An apparatus to be connected between a water pipe and a showerhead of a shower fixture to selectively introduce an additive liquid into a stream of water flowing through the shower head and adapted to be used in conjunction with a container having a containing chamber for the liquid additive and also having a mounting portion which is provided with aspirating air opening means of varying cross-sectional flow area, said container also having a shutoff member at a predetermined shutoff location in the container, said apparatus comprising:

a. a main housing member defining a first through passageway for flow of shower water therethrough, said passageway having a reduced flow area passageway portion to create a low static pressure area, said housing member having a first connecting portion adapted to be connected to said water pipe and a second connecting portion adapted to be connected to said shower fixture, with the first main passageway providing a flow-through connection from the pipe to the showerhead;

b. a second dispensing member having a connecting portion connected to the housing member and an operating portion spaced from the connecting portion, said dispensing member having a lengthwise axis leading from the connecting portion to the operating portion, and a generally circular cross-sectional configuration relative to said lengthwise axis, said dispensing member being formed with a second passageway having an outlet leading into the low pressure flow area of the first passageway and an inlet positioned at the operating portion and spaced laterally from the lengthwise axis, said dispensing member further having an air passageway having an air inlet leading from a lateral surface portion of the dispensing member and an outlet leading to said second passageway between the inlet and the outlet thereof;

c. the second dispensing member being arranged relative to the container so that the mounting portion of the container can be rotatably connected to the second member, with rotation of the container relative to the connecting member enabling the air opening means to be selectively aligned with the inlet of the air passageway, and with said container being positioned so that there is a gravitational component of flow from said containing chamber to said second passageway, and also enabling the shutoff member to be selectively positioned at said shutoff location to stop flow of additive liquid into the inlet of the second passageway;

d. said apparatus being arranged so that with the apparatus connected between the pipe and the showerhead, the container can be mounted to the apparatus, and with water flowing through the apparatus, said container can be selectively rotated to cause the additive liquid to flow into the water, with selective alignment of the air opening means with the air passageway resulting in greater or less air flow through the air passageway while flow of the additive liquid is maintained in the second passageway to vary rate of flow of the additive liquid into the water passing through the apparatus.

14. The apparatus as recited in claim 13, wherein said second member has an outer generally cylindrical surface to allow the container to be moved onto the second member so as to be mounted thereto, and also to permit rotation of the container about the lengthwise axis of the second member.

15. The apparatus as recited in claim 13, wherein said second dispensing member is arranged to have the inlet for the second passageway positioned above the outlet for the second passageway, whereby there is gravity flow of liquid through the second passageway.

16. A container adapted to be used with a dispensing device which is arranged to selectively introduce additive liquid into a stream of water flowing through a shower head, where the device comprises:

a. a main housing member defining a first through passageway for flow of shower water therethrough, said passageway having a reduced flow area passageway portion to create a low static pressure area, said housing member being connected to said shower head, with the first main passageway providing a flowthrough connection to the shower head;

b. a second dispensing member having a connecting portion connected to the housing member and an operating portion spaced from the connecting portion, said dispensing member having a lengthwise axis leading from the connecting portion to the operating portion, and a generally circular cross-sectional configuration relative to said lengthwise axis, said dispensing member being formed with a second passageway having an outlet leading into the low pressure flow area of the first passageway and an inlet positioned at the operating portion and spaced laterally from the lengthwise axis, said dispensing member further having an air passageway having an air inlet leading from a lateral surface portion of the dispensing member and an outlet leading to said second passageway between the inlet and the outlet thereof; said container comprising:

a. a main containing portion having a containing chamber to contain the additive liquid;

b. a mounting portion by which said container can be mounted to said dispensing member so as to be movable relative to the dispensing member;

c. said mounting portion having air opening means which has a variable cross-sectional flow area, and which is arranged so that with the mounting portion mounted to the dispensing member, and with said container being positioned so that there is a gravitational component of flow from said containing chamber to said second passageway, inlet flow area of the air opening means leading into the third passageway can be varied by selectively moving the container to different positions relative to the second member to cause greater or less air flow through the air passageway while flow of additive liquid is maintained in the second passageway, to vary the flow of the additive liquid through the second passageway;

d. a shutoff member positioned in said container so as to be able to come into closing engagement with the second passageway by moving the container relative to the second member.

17. The container as recited in claim 16, wherein the mounting portion of the container is arranged so as to be rotatably mounted to the second member about the lengthwise axis of the second member.

18. The container as recited in claim 17, wherein said air opening means comprises a plurality of spaced air openings in said mounting portion which come into alignment with the third passageway by rotation of said container about the lengthwise axis of the dispensing member.

19. The container as recited in claim 17, wherein said air opening means comprises a tapered passageway means, portions of which come into alignment with the third passageway by rotation of the container about the lengthwise axis of the dispensing member.

20. The container as recited in claim 16, wherein said air opening means comprises a plurality of spaced air openings in said mounting portion.

21. The container as recited in claim 20, wherein there are two sets of air openings formed in the mounting portion of the container, with the two sets of air openings being positioned diametrically opposite to one another, with each set being made up of openings of varying sizes, whereby the container can be rotated in either of two directions to accomplish selective positioning of either set of openings.

22. The container as recited in claim 20, wherein there are a plurality of shutoff members which are positioned to come into closing engagement with the inlet to the second passageway when the container is positioned so that adjacent pairs of openings are out of alignment with the air passageway, whereby when the container is being rotated to one opening alignment position from another opening alignment position, flow of liquid is shut off during movement of the container from the one opening alignment position to the other.

23. A method to selectively introduce an additive liquid into a stream of water flowing through a shower head, said method comprising:

a. directing said stream of water through a first main through passageway formed in a main housing member, said passageway having a reduced flow area passageway portion to create a low static pressure flow area;

b. providing a second dispensing member connected to said housing member and defining a second passageway having an inlet end and an outlet leading into the low pressure flow area of the first passageway;

c. providing an additive liquid in a containing chamber of a container and mounting said container to said second member so that said container can be moved relative to the second member and so that said inlet of the second passageway communicates with the containing chamber, with said container being positioned so that there is a gravitational component of flow from said containing chamber to said second passageway; and d. selectively moving the container relative to the second member to selectively introduce air into aspirating air passageway means connecting to said second passageway, said air passageway means being arranged so that relative movement between the container and the second member to selected positions results in greater or less air flow through the air passageway means to the second passageway while maintaining flow of the additive liquid through the second passageway to vary flow of additive liquid through the second passageway to the first main passageway.

24. The method as recited in claim 23, wherein said second member has a lengthwise axis, with the second member extending outwardly from the first main passageway along said lengthwise axis, said method further comprising rotating the container about said lengthwise axis for selective introduction of air into the air passageway means.

25. The method as recited in claim 23, wherein said second member has a generally circular cross-sectional configuration, and said container has a mounting portion which fits over said second member in mounting engagement therewith, said air passageway means comprising a third air passageway extending through said second member to said second passageway, said mounting portion of the container having a plurality of through air openings of different sizes, said method further comprising introducing air flow through the third passageway by selectively aligning one of said air openings with said air passageway.

26. The method as recited in claim 25, wherein said container is mounted to said second member for rotation about a lengthwise axis of said second member, and said air openings are selectively aligned with the third passageway by rotating the container relative to the second member.

27. The method as recited in claim 26, wherein said container is provided with a shutoff member positioned in said container, said method further comprising moving the shutoff member into closing engagement with an inlet of the second passageway, with the shutoff member being positioned so that when it is at a shutoff position, the container is positioned so that the air openings are out of alignment with the inlet of the third passageway.

28. The method as recited in claim 23, wherein said container has a shutoff member arranged to come into closing engagement with an inlet to the second passageway when the container is in a predetermined position relative to the second member, said method further comprising moving the container relative to the second member, so that flow of liquid in the container through the second passageway can be controlled, and flow of air into the second passageway can also be controlled.

* * * * *